US005415304A

United States Patent [19]

Hanes et al.

[11] Patent Number: 5,415,304

[45] Date of Patent: May 16, 1995

[54] YOKE CASTING FOR A DRAWBAR ASSEMBLY

[75] Inventors: Douglas M. Hanes; Jeffrey D. Wurzer, both of Pittsburgh; Peter S. Mautino, Verona, all of Pa.

[73] Assignee: McConway & Torley Corporation, Pittsburgh, Pa.

[21] Appl. No.: 148,379

[22] Filed: Nov. 8, 1993

[51] Int. Cl.[6] ..... B61G 7/00

[52] U.S. Cl. ..... 213/50.5; 213/50

[58] Field of Search ..... 213/50, 50.5, 56, 58, 213/60, 67 R, 67 A, 68, 69, 70, 71, 72

[56] References Cited

U.S. PATENT DOCUMENTS

| | | | |
|---|---|---|---|
| 1,557,060 | 10/1925 | Kadel . | |
| 1,925,998 | 9/1933 | Barrows | 213/50 |
| 2,241,353 | 5/1941 | Kinne et al. . | |
| 4,445,617 | 5/1984 | Elliott | 213/50 |
| 4,531,648 | 7/1985 | Paton . | |
| 4,555,033 | 11/1985 | Miller . | |
| 4,580,686 | 4/1986 | Elliott . | |
| 4,597,499 | 7/1986 | Hanula | 213/50.5 |
| 4,700,853 | 10/1987 | Altherr et al. . | |
| 4,846,358 | 7/1989 | Rhen . | |
| 4,946,052 | 8/1990 | Kaim et al. . | |
| 5,035,338 | 7/1991 | Kaufhold et al. . | |

*Primary Examiner*—Mark T. Le

*Attorney, Agent, or Firm*—James Ray & Associates

[57] ABSTRACT

An integral single piece yoke casting for connecting one end of a railway car. Such single piece yoke casting includes a first side wall portion having a front face portion which engages at least a portion of a rear face of a front stop member secured within a longitudinal opening of a center sill member. A second side wall portion having a front face portion engages at least a portion of a rear face of another front stop member secured within such longitudinal opening of such center sill member. A horizontally disposed top wall portion, having a third predetermined length and a horizontally disposed bottom wall portion, having a fourth predetermined length, in conjunction with the first side wall portion and the second side wall portion form a generally rectangular yoke casting. A first vertically disposed aperture, having a first predetermined diameter, is formed through such top wall portion at a predetermined location and an axially opposed second vertically disposed aperture, having a second predetermined diameter, is formed through such bottom wall portion at a predetermined location.

20 Claims, 2 Drawing Sheets

YOKE CASTING FOR A DRAWBAR ASSEMBLY

FIELD OF THE INVENTION

The present invention relates, in general, to a yoke used in a slackless drawbar system for connecting adjacent ends of a pair of railway cars together, in a substantially semipermanent manner, and, more particularly, this invention relates to a yoke casting formed as an integral single piece member for use in such drawbar assembly.

CROSS REFERENCE TO RELATED APPLICATIONS

This patent application is closely related to a patent application titled "FRONT DRAFT STOP FOR USE IN A DRAWBAR ASSEMBLY" Ser. No. 08/149,054, filed Nov. 8, 1993, and a patent application titled "RAILWAY CAR SLACKLESS DRAWBAR ASSEMBLY" Ser. No. 08/148,357, filed Nov. 8, 1993, each of these patent applications is being filed concurrently herewith and they are assigned to the same assignee. Each of these patent applications is incorporated herein by reference thereto.

BACKGROUND OF THE INVENTION

As is well known, railway cars are connected together by coupler members. Such couplers may be conventional couplers, articulated couplers or drawbars. Conventional couplers are independent units disposed on an end of each car which interconnect with one another, between adjacent cars, to form a connection. Drawbar assemblies are integral units which extend between the ends of two adjacent cars to form a semipermanent connection therebetween.

In either instance, however, a shank end of the coupler or drawbar will extend into the center sill of a railway car where it is secured so as to transmit longitudinal forces to the car during in track service.

Certain prior inventions have been directed to improvements in the center sill construction for receiving primarily conventional couplers. However, these improvements may also have application in receiving couplers in a slackless system. By slackless, it is meant that the drawbar (or coupler) is received within the center sill in a manner to minimize longitudinal play or movements. However, because it is important for successive railway cars in a train to be able to accommodate relative movement between cars when curves and inclines are negotiated, there must be provision for each car to move in pitch, yaw and roll modes with respect to the coupler member. Moreover, there must be a provision to periodically remove the draft components for repair and replacement of parts and, in connection with drawbar systems, to disconnect connected cars.

In a slackless system, the coupler member is held in a way to eliminate, or minimize, longitudinal movement with respect to the railway car body. This may be done by providing a tapered wedge between a rear wall of a pocket casting (secured in the center sill) and a follower block which rests against the butt end of the coupler member. The wedge tends to force the follower block away from the pocket casting end wall and firmly against the butt end of the drawbar member shank. When cars are being pushed, during operation, the longitudinal forces will cause compression of the drawbar member against the follower block, tapered wedge and pocket end wall.

Conversely, when the railway cars are being pulled, the longitudinal forces tending to separate the drawbar from the pocket casting are countered in some systems by a draft key which is a metal bar that extends laterally of the car center sill through slots in the sidewalls of the center sill and a slot in the shank of the coupler member and in other slackless drawbar systems by a connecting pin.

In a slackless drawbar system, the drawbar is held tightly between the bearing block and follower block by operation of the tapered wedge which separates the pocket casting and follower block and compresses the follower block against the drawbar to force the latter against the bearing block and follower block. However, the mating faces of the follower block and drawbar are preferably curved to permit the drawbar to pivot slightly both vertically and laterally and to permit the car to roll with respect to the drawbar.

Prior to the present invention, the yokes designed for use only with slackless drawbar assemblies have generally been manufactured from a plurality of pieces. This makes the installation of the yoke more difficult. Furthermore, use of separate pieces will tend to weaken the structure.

SUMMARY OF THE INVENTION

The present invention provides an integral single piece yoke casting for connecting one end of a slackless drawbar to a predetermined end of a railway car. Such drawbar forms a part of a slackless drawbar connection system that is used to connect adjacent predetermined ends of a pair of railway cars together, in a substantially semipermanent manner. Such integral single piece yoke casting includes a first vertically disposed generally rectangular shaped side wall portion having a first predetermined length. Such first side wall portion includes a front face portion which is engageable with at least a portion of a rear face of a first vertically disposed front stop member. The first front stop member being secured within a longitudinal opening of a center sill member. Such yoke casting further has a second vertically disposed generally rectangular shaped side wall portion having a second predetermined length. This second side wall portion also includes a front face portion which is engageable with at least a portion of a rear face of a second vertically disposed front stop member secured within such longitudinal opening of such center sill member axially opposite such first front stop member. The yoke casting has a horizontally disposed top wall portion, having a third predetermined length and a horizontally disposed bottom wall portion, having a fourth predetermined length. Such third predetermined length of the top wall portion and such fourth predetermined length of such bottom wall portion being substantially longer than the first predetermined length of the first side wall portion and the second predetermined length of the second side wall portion. A first vertically disposed aperture, having a first predetermined diameter, is formed through such top wall portion at a predetermined location and an axially opposed second vertically disposed aperture, having a second predetermined diameter, is formed through said bottom wall portion at a predetermined location.

OBJECTS OF THE INVENTION

It is, therefore, one of the primary objects of the present invention to provide a yoke for use in a slackless drawbar assembly which is an integral single piece casting.

Another object of the present invention is to provide a yoke for use in a slackless drawbar system which is relatively easy to install.

Still another object of the present invention is to provide a yoke for use in a slackless drawbar system which will not separate when buff and draft loads are applied thereto by in train actions encountered.

Yet another object of the present invention is to provide a yoke for use in a slackless drawbar system which will require less maintenance.

A further object of the present invention is to provide a yoke for use in a slackless drawbar system which is relatively light weight.

An additional object of the present invention is to provide a yoke for use in a slackless drawbar system which can be retrofitted to existing slackless drawbar assemblies and to existing railway cars.

Still another object of the present invention is to provide a yoke for use in a slackless drawbar system which will enable freer movement of the drawbar within the yoke.

In addition to the various objects and advantages of the integral single piece yoke casting discussed above, it should be understood that various other objects and advantages of the present invention will become more readily apparent to those persons who are skilled in the coupler art from the following more detailed description, particularly, when such description is taken in conjunction with the attached drawing and with the appended claims.

DESCRIPTION OF THE PREFERRED EMBODIMENTS OF THE INVENTION

Figure 1:
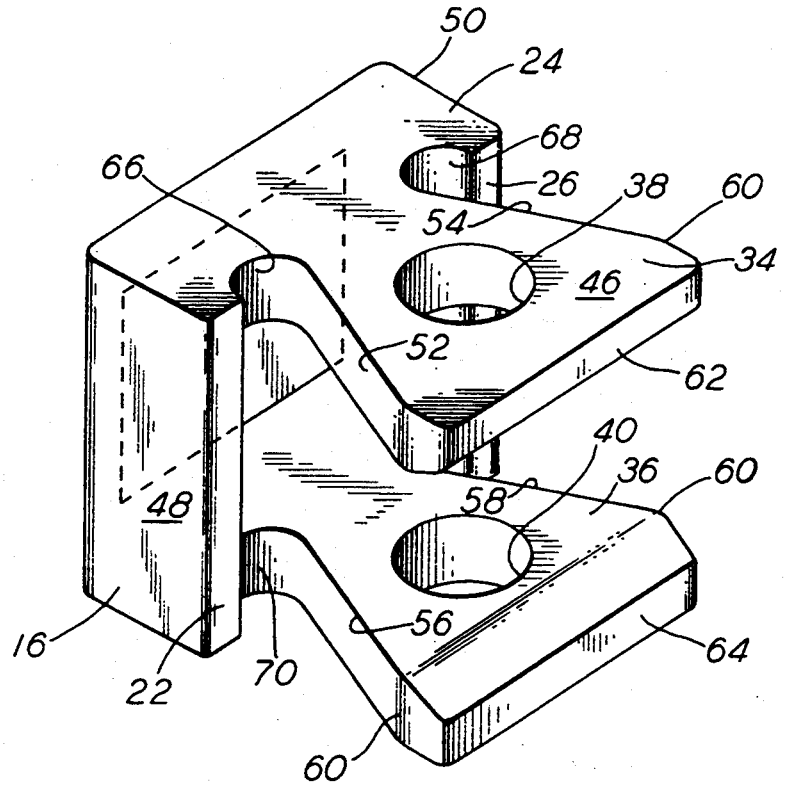
FIG. 1 is a perspective view which illustrates all of the essential elements of a presently preferred integral single piece yoke casting, according to the presently preferred embodiment of the invention.

Prior to proceeding to the more detailed description of the integral single piece yoke casting, it should be noted that, for the sake of clarity, identical components, having identical functions, have been designated with identical reference numerals throughout the drawing Figures.

Figure 2:
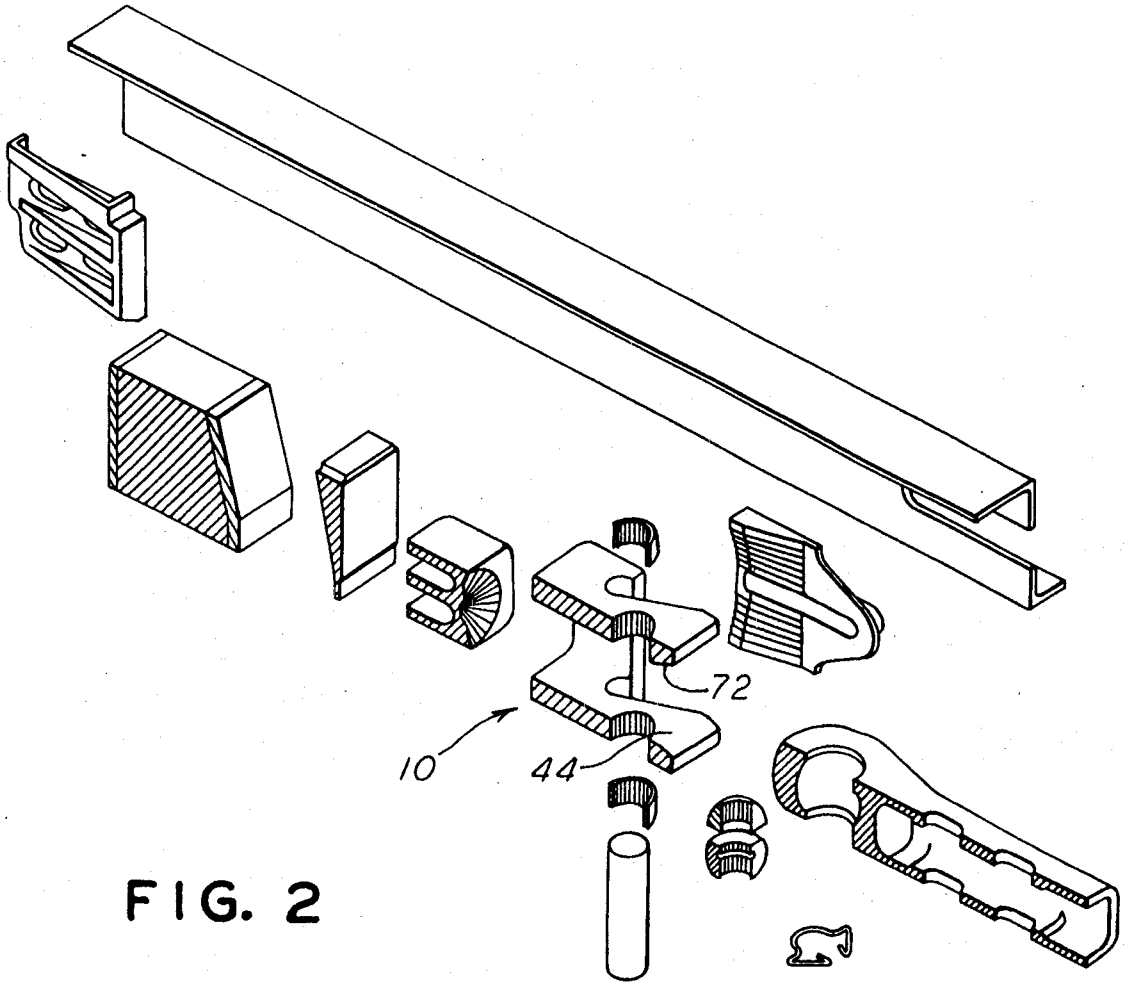
FIG. 2 is an exploded view partially in cross section which illustrates the use of the integral single piece yoke casting in one presently preferred slackless drawbar assembly.

Now refer, now particularly, to FIGS. 1 and 2. Illustrated therein, is an integral single piece yoke casting, generally designated, 10 for connecting one end 12 of a slackless drawbar, generally designated, 20 to a predetermined end of a center sill member 14 connected to a railway car (not shown) along a longitudinal centerline thereof.

Such drawbar 20 forms a part of a slackless drawbar connection system, generally designated, 30. Slackless drawbar connection system 30 is utilized, in the railway industry, to connect adjacent predetermined ends of a pair of such railway cars together, in a substantially semipermanent manner.

In the presently preferred embodiment of the invention, the integral single piece yoke casting 10 includes a first vertically disposed side wall portion 16. First side wall portion 16 has a first predetermined length and is generally rectangular in shape. A height of such first side wall portion 16 closely corresponds to the height of an opening 18 in such center sill member 14. Center sill member 14 is secured to a bottom portion (not shown) of a railway car body member. The first side wall portion 16 has a front face portion 22 which is engageable with at least a portion of a rear face (not shown) of a first vertically disposed front stop member (not shown). The first front stop member is secured within the opening 18 of the center sill member 14, preferably by welding.

The integral single piece yoke casting 10 further includes a second vertically disposed side wall portion 24. Second side wall portion 24 has a second predetermined length and is generally rectangular in shape. A height of such second side wall portion 24 closely corresponds to the height of the opening 18 in such center sill member 14. The second side wall portion 24 has a front face portion 26 which is engageable with at least a portion of a rear face 28 (FIG. 2) of a second vertically disposed front stop member 32. The second front stop member 32 is also secured within the opening 18 of the center sill member 14, preferably by welding.

A third essential element of such yoke casting 10 is a horizontally disposed top wall portion 34. Top wall portion 34 has a third predetermined length.

Another essential element of yoke casting 10 is a horizontally disposed bottom wall portion 36, having a fourth predetermined length. Such third predetermined length of the top wall portion 34 and the fourth predetermined length of such bottom wall portion 36 being substantially longer than the first predetermined length of such first side wall portion 16 and the second predetermined length of the second side wall portion 24.

The final essential elements of the yoke casting 10 are a first vertically disposed aperture 38, having a first predetermined diameter, and an axially opposed second vertically disposed aperture 40, having a second predetermined diameter. The first aperture 38 is formed through the top wall portion 34 at a predetermined location and the axially opposed second aperture 40 is formed through the bottom wall portion 36.

In the presently preferred embodiment of the invention, the first predetermined length of such first side wall portion 16 will be substantially identical to the second predetermined length of the second side wall portion 24. In addition, in this preferred embodiment, such third predetermined length of the top wall portion 34 will be substantially identical to such fourth predetermined length of the bottom wall portion 36.

It is, also, preferred that each of such third predetermined length of the top wall portion 34 and the fourth predetermined length of such bottom wall portion 36 will be at least two times as long as each of the first predetermined length of such first side wall portion 16 and the second predetermined length of such second side wall portion 24.

In the embodiment of the invention presently being described, the inner surface 42 of such first side wall portion 16 and the inner surface of the second side wall portion 24 are disposed substantially parallel to each other. Furthermore, in the present invention, the bottom surface of such top wall portion 34 will be disposed substantially parallel to the upper surface 44 of the bottom wall portion 36.

As can be seen in the drawings, the yoke casting 10 is open at each end thereof. The opening located at the rear of such yoke casting 10 is defined by each of such inner surface 42 of the first side wall portion 16, the inner surface of the second side wall portion 24, the bottom surface of such top wall portion 34 and the upper surface 44 of such bottom wall portion 36.

In the preferred embodiment, the upper surface 46 of the top wall portion 34 and the bottom surface of such bottom wall portion 36 are disposed substantially parallel to one another. The outer surface 48 of such first side wall portion 16 and the outer surface 50 of the second side wall portion 24 are also disposed substantially parallel to each other.

It is clear from the above description that such outer surface 48 of the first side wall portion 16 and such outer surface 50 of the second side wall portion 24 in conjunction with the upper surface 46 of such top wall portion 34 and the bottom surface of such bottom wall portion 36 form a generally rectangular shape. Such rectangular shape having a predetermined height and a predetermined width which closely correspond to a respective height and width of the longitudinal opening 18 of such center sill member 14.

In the presently preferred embodiment of the invention, each outer edge 52 and 54 of the top wall portion 34 is tapered inwardly toward a longitudinal centerline of such yoke casting 10 at a first predetermined angle and rearwardly for a predetermined distance from a predetermined point 60. The predetermined point 60 is disposed a predetermined distance from the first face 62 of the top wall portion 34. Likewise, each outer edge 56 and 58 of the bottom wall portion 36 is tapered inwardly toward such longitudinal center of such yoke casting 10, preferably, at the same predetermined angle and rearwardly, preferably, for the same predetermined distance and, preferably, from the same predetermined point 60 disposed, preferably, the same distance from a front face 64 of the bottom wall portion 36.

In the preferred embodiment of the invention, such top wall portion 34 includes a first arcuately shaped portion 66 disposed between an inner surface 42 of such first vertically disposed side wall portion 16 and the first outer surface 52 of such top wall portion 34 located adjacent a rear surface of the tapered first outer surface 52 of such top wall portion 34. A second arcuately shaped portion 68, of top wall portion 34, is disposed between the inner surface of such second side wall member 24 and the second outer surface 54 adjacent the rear surface of such tapered second outer surface 54.

Also, in this embodiment, the bottom wall portion 36 includes a first arcuately shaped portion 70 disposed between an inner surface 42 of such first vertically disposed side wall member 16 and the first outer surface 56 of such bottom wall portion 36 located adjacent a rear surface of the tapered first outer surface 56 of such bottom wall portion 36. A second arcuately shaped portion of such bottom wall portion 36 is disposed between the inner surface of such second side wall member 24 and the second outer surface 58 adjacent the rear surface of such tapered second outer surface.

As best seen in FIG. 2, in order to ensure the requisite movement required of the drawbar 20, the bottom surface 72 of the top wall portion 34 is tapered downwardly, at a first predetermined angle, and inwardly from a front face portion 62 of such top wall portion 34 for a first predetermined distance. Also, the top surface 44 of the bottom wall portion 36 is tapered upwardly, at a second predetermined angle, and inwardly from the front face portion 64 of such bottom wall portion 36 for a second predetermined distance. Preferably, such first predetermined angle will be substantially identical to such second predetermined angle and such first predetermined distance will be substantially identical to such second predetermined distance.

Finally, such integral single piece yoke casting 10 will be manufactured as a steel casting. Further it is within the scope of the present invention that certain areas of the yoke casting 10 which will be subjected to wear may be hardened.

Although a number of presently preferred embodiments of the integral single piece yoke casting have been described in detail above, it should be understood that various modifications and adaptations of the instant invention may be made by persons skilled in the railroad coupling art without departing from the spirit and scope of the appended claims.

We claim:

1. An integral single piece yoke casting for connecting at least one end of a slackless drawbar to a predetermined end of a railway car, such drawbar forms a part of a slackless drawbar connection system utilized to connect adjacent predetermined ends of a pair of railway cars together, in a substantially semipermanent manner, said integral single piece yoke casting comprising:

(a) a first vertically disposed generally rectangular shaped side wall portion having a first predetermined length, said first side wall portion having a front face portion which is engageable with at least a portion of a rear face of a vertically disposed front stop member secured within a longitudinal opening of a center sill member;

(b) a second vertically disposed generally rectangular shaped side wall portion having a second predetermined length, said second side wall portion having a front face portion which is engageable with at least a portion of a rear face of another vertically disposed front stop member secured within such longitudinal opening of such center sill member;

(c) a horizontally disposed top wall portion having a third predetermined length;

(d) a horizontally disposed bottom wall portion having a fourth predetermined length, said third predetermined length of said top wall portion and said fourth predetermined length of said bottom wall portion being substantially longer than said first predetermined length of said first side wall portion and said second predetermined length of said second side wall portion;

(e) a first vertically disposed cylindrical aperture, having a circular cross-section and a first predetermined diameter, formed through said top wall portion at a predetermined location; and (f) an axially opposed second vertically disposed cylindrical aperture, having a circular cross-section and a second predetermined diameter, formed through said bottom wall portion at a predetermined location.

2. An integral single piece yoke casting, according to claim 1, wherein said first predetermined length of said first side wall portion and said second predetermined length of said second side wall portion are substantially identical.

3. An integral single piece yoke casting, according to claim 2, wherein said third predetermined length of said top wall portion and said fourth predetermined length of said bottom wall portion are substantially identical.

4. An integral single piece yoke casting, according to claim 3, wherein said third predetermined length of said top wall portion and said fourth predetermined length of said bottom wall portion are at least twice as long as said first predetermined length of said first side wall portion and said second predetermined length of said second side wall portion.

5. An integral single piece yoke casting, according to claim 1, wherein an inner surface of said first side wall portion and an inner surface of said second side wall portion are substantially parallel to one another.

6. An integral single piece yoke casting, according to claim 5, wherein a bottom surface of said top wall portion and an upper surface of said bottom wall portion are substantially parallel to one another.

7. An integral single piece yoke casting, according to claim 6, wherein said integral single piece yoke casting is open at each end thereof.

8. An integral single piece yoke casting, according to claim 7, wherein each of said inner surface of said first side wall portion, said inner surface of said second side wall portion, said bottom surface of said top wall portion and said upper surface of said bottom wall portion define an opening at a rear of said yoke casting.

9. An integral single piece yoke casting, according to claim 8, wherein an upper surface of said top wall portion and a bottom surface of said bottom wall portion are substantially parallel to one another.

10. An integral single piece yoke casting, according to claim 9, wherein an outer surface of said first side wall portion and an outer surface of said second side wall portion are substantially parallel to one another.

11. An integral single piece yoke casting, according to claim 10, wherein said outer surface of said first side wall portion, said outer surface of said second side wall portion, said upper surface of said top wall portion and said bottom surface of said bottom wall portion form a generally rectangular shape having a predetermined height and a predetermined width which closely corresponds to a height and a width of such longitudinal opening in such center sill member.

12. An integral single piece yoke casting, according to claim 1, wherein each outer edge of said top wall portion is tapered inwardly toward a longitudinal centerline of said yoke casting at a predetermined angle and rearwardly for a predetermined distance from a predetermined point disposed a predetermined distance from a front face of said top wall portion.

13. An integral single piece yoke casting, according to claim 12, wherein each outer edge of said bottom wall portion is tapered inwardly toward said longitudinal centerline of said yoke casting at said predetermined angle and rearwardly for said predetermined distance from said predetermined point disposed said predetermined distance from a front face of said bottom wall portion.

14. An integral single piece yoke casting, according to claim 13, wherein said top wall portion further includes a first arcuately shaped portion disposed between an inner surface of said first side wall portion and a first outer edge of said top wall portion adjacent a rear of said taper and a second arcuately shaped portion disposed between an inner surface of said second side wall portion and a second outer edge of said top wall portion adjacent a rear of said taper.

15. An integral single piece yoke casting, according to claim 14, wherein said bottom wall portion further includes a first arcuately shaped portion disposed between an inner surface of said first side wall portion and a first outer edge of said bottom wall portion adjacent a rear of said taper and a second arcuately shaped portion disposed between an inner surface of said second side wall portion and a second outer edge of said bottom wall portion adjacent a rear of said taper.

16. An integral single piece yoke casting, according to claim 15, wherein a bottom surface of said top wall portion is tapered downwardly at a first predetermined angle and inwardly toward said longitudinal centerline from a front face portion of said top wall portion for a first predetermined distance.

17. An integral single piece yoke casting, according to claim 16, wherein a top surface of said bottom wall portion is tapered upwardly at a second predetermined angle and inwardly toward said longitudinal centerline from a front face portion of said bottom wall portion for a second predetermined distance.

18. An integral single piece yoke casting, according to claim 17, wherein said first predetermined angle and said second predetermined angle are substantially identical.

19. An integral single piece yoke casting, according to claim 18, wherein said first predetermined distance and said second predetermined distance are substantially identical.

20. An integral single piece yoke casting, according to claim 1, wherein said integral single piece yoke casting is a steel casting.

* * * * *